United States Patent [19]

Higgins

[11] 4,160,544

[45] Jul. 10, 1979

[54] SMALL DIAMETER, SINGLE CONE COIL SPRING FOR USE IN A BOX SPRING ASSEMBLY

[75] Inventor: Larry Higgins, Carthage, Mo.

[73] Assignee: Leggett & Platt, Incorporated, Carthage, Mo.

[21] Appl. No.: 877,159

[22] Filed: Feb. 13, 1978

Related U.S. Application Data

[60] Division of Ser. No. 784,439, Apr. 4, 1977, Pat. No. 4,112,528, which is a continuation-in-part of Ser. No. 726,811, Sep. 27, 1976, abandoned.

[51] Int. Cl.[2] ..... F16F 1/08

[52] U.S. Cl. ..... 267/166; 5/248; 5/256; 267/91; 267/100; 267/180

[58] Field of Search ..... 267/91, 100, 101, 167, 267/166, 180; 5/248, 256, 267

[56] References Cited

U.S. PATENT DOCUMENTS

| | | | |
|---|---|---|---|
| 3,270,354 | 9/1966 | Ciampa et al. | 5/260 |
| 3,577,574 | 5/1971 | Ciampa | 5/267 |
| 3,767,180 | 10/1973 | Kaiser | 267/91 |
| 3,774,248 | 11/1973 | Huras et al. | 5/267 |
| 3,916,463 | 11/1975 | Higgins | 5/264 R |

*Primary Examiner*—George E. A. Halvosa

*Attorney, Agent, or Firm*—Wood, Herron & Evans

[57] ABSTRACT

An improved single cone coil spring and an improved box spring assembly made from the improved single cone coil springs. The box spring assembly comprises a base frame, a series of the improved small diameter single cone coil springs and a welded wire grid, the coil springs being connected at their bottom ends to the base frame and connected at their top ends to the welded wire grid. The coil springs are established in a plurality of rows and columns throughout the box spring assembly, at least one transverse wire and at least one longitudinal wire of the wire grid span all coil springs within each row and column, respectively. Further, a supplemental transverse wire is positioned between adjacent coil spring rows, and is of a length equal to at least one of the coil springs' transverse wires adjacent thereto. All crossover points of all the grid's transverse and longitudinal wires are welded to establish the welded wire grid. The improved single cone coil springs are all of the same diameter, that diameter being less than three and one-half inches in the top loop of the coil springs. The coil spring columns are separated one from the other, and the coil spring rows are separated one from the other, by a distance at least as great as the diameter of the coil springs.

3 Claims, 6 Drawing Figures

SMALL DIAMETER, SINGLE CONE COIL SPRING FOR USE IN A BOX SPRING ASSEMBLY

This is a division of application Ser. No. 784,439, filed Apr. 4, 1977, now U.S. Pat. No. 4,112,528, which is in turn a continuation-in-part of application Ser. No. 726,811, filed Sept. 27, 1976, now abandoned.

This invention relates to bedding foundations. More particularly, this application relates to an improved box spring assembly of the type commonly employed as a foundation base for a mattress.

A box spring assembly generally includes a plurality of springs mounted in a series of columns and rows to a base frame, that base frame including a plurality of transverse slats that extend between side rails of the frame. One type of spring well known to the prior art is known as a single cone coil spring, that type spring having a regular frustoconical geometry. When single cone coil springs are used, a plurality of those springs are vertically mounted atop the base frame by fastening the small diameter bottom loop of each to the base frame, thereby connecting the bottom ends of the coil springs together. The single cone coil springs are also connected at their top ends, the large diameter top loops of the coil springs being generally connected together by a series of wires. The series of wires connecting the coil springs' top loops together may be either in the form of a helical wire extending horizontally between the top loops of adjacent coil springs within a given column or row, or by a number of wire links each of which is hooked at one end to one coil spring and at the other end to an adjacent coil spring, or by a number of hooks integral with a welded wire grid which overlies the coil springs. The box spring assembly is completed by placing a cushion or pad of material, e.g., woven or nonwoven batting or foam rubber or the like over the top surface of the coil spring assembly, and then enclosing that structure within an upholstered fabric or cloth sheath.

Customer demand in recent years has required that bed foundations have greater firmness, i.e., reduced softness, relative to those foundations sold in earlier years. From a historical standpoint, box spring assemblies using the single cone type coil spring initially made use of single cone coil springs having a top loop diameter of five inches or so. The single cone coil spring was of a regular frustoconical geometry with the bottom loop being about one-half the diameter of the top loop. Typical of such prior art single cone type coil springs are those illustrated in U.S. Pat. Nos. 3,270,354 and 3,577,574. But such prior art single cone coil springs of a five inch diameter are inherently soft and, indeed, too soft to meet the firmness requirement necessitated in today's marketplace unless the wire from which those springs are fabricated is increased substantially in gauge. But that heavier wire gauge increases the manufacturing cost of a box spring assembly to the point where production at a competitive price is not always possible because of the increased cost of the coil spring components. In other words, box spring assemblies fabricated with five inch diameter conical coil springs of the usual gauge spring wire, and particularly those fabricated of single cone type coil springs, are too soft as the majority of today's bedding customers desire more firm box spring assemblies.

One approach to increasing the firmness of such single cone coil springs has been to decrease the diameter of the lower loop of the spring while maintaining the topmost loop at its original approximately five inch diameter. That is, the top loop diameter of the coil spring is in the neighborhood of five inches (as with the original soft single cone type coil springs), but the next adjacent top loop is shrunk substantially in diameter to, e.g., three inches. In this type coil spring, the single cone type coil spring of regular frustoconical configuration is inherent in the coil spring from its bottom loop to the loop next adjacent to the top loop only. The objective of this coil spring structure is to provide a plane of coil spring loops in the top plane of the box spring assembly that has no substantial holes therein so as to eliminate the padding abrasion or "holes" for the padding to work through when padding is subsequently placed on a spring assembly and a unit covered and placed in use. In other words, the large diameter top loop is provided to prevent padding abrasion problems in the box spring assembly, and the small diameter single cone type coil spring integral with that top loop and depending therefrom is provided to effect increased firmness in the box spring assembly. But this approach provided problems in that the big loop offered no increased firmness to the mattress and, indeed, acted like a long lever from its interconnection point with the coil spring to the outer end of the top loop, thereby lessening the firmness in the box spring assembly. Further, presence of the over-sized loop in the top surface of the box spring assembly caused a degree of loss in lateral stability of the unit. This type conical coil spring with large diameter top loop is illustrated in U.S. Pat. No. 3,916,463, see particularly FIG. 1 of that patent.

This invention is predicated upon, and one very important aspect of this invention is based upon, the discovery that single cone coil springs having a small top loop diameter (as for example less than $3\frac{1}{2}''$) are much firmer than otherwise identical single cone springs having a large diameter top loop (greater than 4") and surprisingly have a very desirable straight line load to deflection graph plot. This straight line graph plot reflects the fact that the load required to effect a given increment of deflection remains constant as the spring deflects. I have found that standard single cone coil springs of the type commonly used in box springs today (having a top loop diameter of approximately $4\frac{1}{2}''$) have a load to deflection curve plot which is convex, reflecting the fact that the load required to effect a given increment of deflection increases as the coil deflects or compresses.

Accordingly, it has been one objective of this invention to incorporate the advantageous properties of small diameter single cone spring units into a box spring assembly.

Another aspect of this invention is predicated upon a novel and improved box spring assembly which incorporates small diameter conical type coil springs in a plurality of row and columns, those rows and columns being held in spaced relation relative one to another by a welded wire grid comprised of laterally and longitudinally extending wire overlying one another in matrix like fashion and welded one to another at all crossover points with that grid being interconnected with all springs, each of the coil springs having a top loop diameter no greater than three and one-half inches with all of the coil springs being identical in size and configuration one to another, and with each of the coil springs being spaced from all adjacent coil springs a distance at least as great as the top loop diameter of the coil spring used.

In accord with this objective, the improved box spring assembly of this invention comprises a base frame, a series of improved single cone coil springs and a welded wire grid, the coil springs being connected at their bottom ends to the base frame and connected at their top ends to the welded wire grid. The coil springs are established in a plurality of rows and columns throughout the box spring assembly, at least one transverse wire and at least one longitudinal wire of the wire grid span all coil springs within each row and column, respectively. Further, a supplemental transverse wire is positioned between adjacent coil spring rows, and is of a length equal to at least one of the coil spring transverse wires adjacent thereto. All crossover points of all the grid's transverse and longitudinal wires are welded to establish the welded wire grid. The coil springs are all of the same diameter, that diameter being less than three and one-half inches at the top ends of the coil springs. The coil spring columns are separated one from the other, and the coil spring rows are separated one from the other, by a distance at least as great as the diameter of the coil springs.

The advantage of this structural combination in a box spring assembly environment is that it utilizes small diameter single cone springs in a box spring wherein the padding which overlies the coil springs and wire grid structure is not abraded by lateral or relative movement of the springs and/or the wire grid during use. Therefore, the padding does not push down between holes between the coil springs, thereby prolonging the useful life of the box spring assembly itself. Further, and importantly, the box spring assembly is provided with a degree of firmness desirable in the present marketing environment for bedding foundations as that firmness is imparted to the box spring assembly by coil springs of small top loop diameter which may be fabricated with wire of even smaller gauge than is now commonly used in box spring assemblies.

While according to the practice of my invention, any welded wire grid may be used in combination with my improved single cone coil spring to secure the top loop of the spring in a relatively fixed axial position, I prefer to use a welded wire grid in which hooks are integrally formed in the grid, which hooks are crimped shut after location of the top loop of the coil springs within a pair of opposed hooks. Such a grid is disclosed in U.S. Pat. No. 3,577,574, issued to Fred A. Ciampa on May 4, 1971.

In order to position small diameter top loops of coils within opposed preformed hooks of the grid and hold them securely therein, I have found that the top loop of the coil must be very accurately sized in order to fit within the hook. This accurate sizing is required because in the case of small diameter coils, a large angular arcuate section of the coil is located within the hook defining section of the grid. Heretofore, in the case of larger diameter coils, the portion of the loop contained within the hook was relatively flat and therefore was not required to be so accurately sized. To this end, I require that each hook of the grid be formed by a double reverse bend in the grid and that the top coil of the single cone spring be sized less than three and one-half inches in diameter and that the nominal diameter of the top loop be accurately maintained within ±0.010 inches through more than a 300° arcuate section of the top loop. This accurate sizing of the top loops of the single cone springs enables the springs to fit within preformed hooks of the grid and then to be securely locked in fixed axial positions by crimping of those preformed hooks. The resulting spring assembly is a spring unit of acceptable durability which has greater firmness imparted to the unit with less wire than has heretofore been possible in a single cone type of spring unit.

Other objectives and advantages of this invention will be more apparent from the following detailed description taken in conjunction with the drawings in which.

Figure 1:
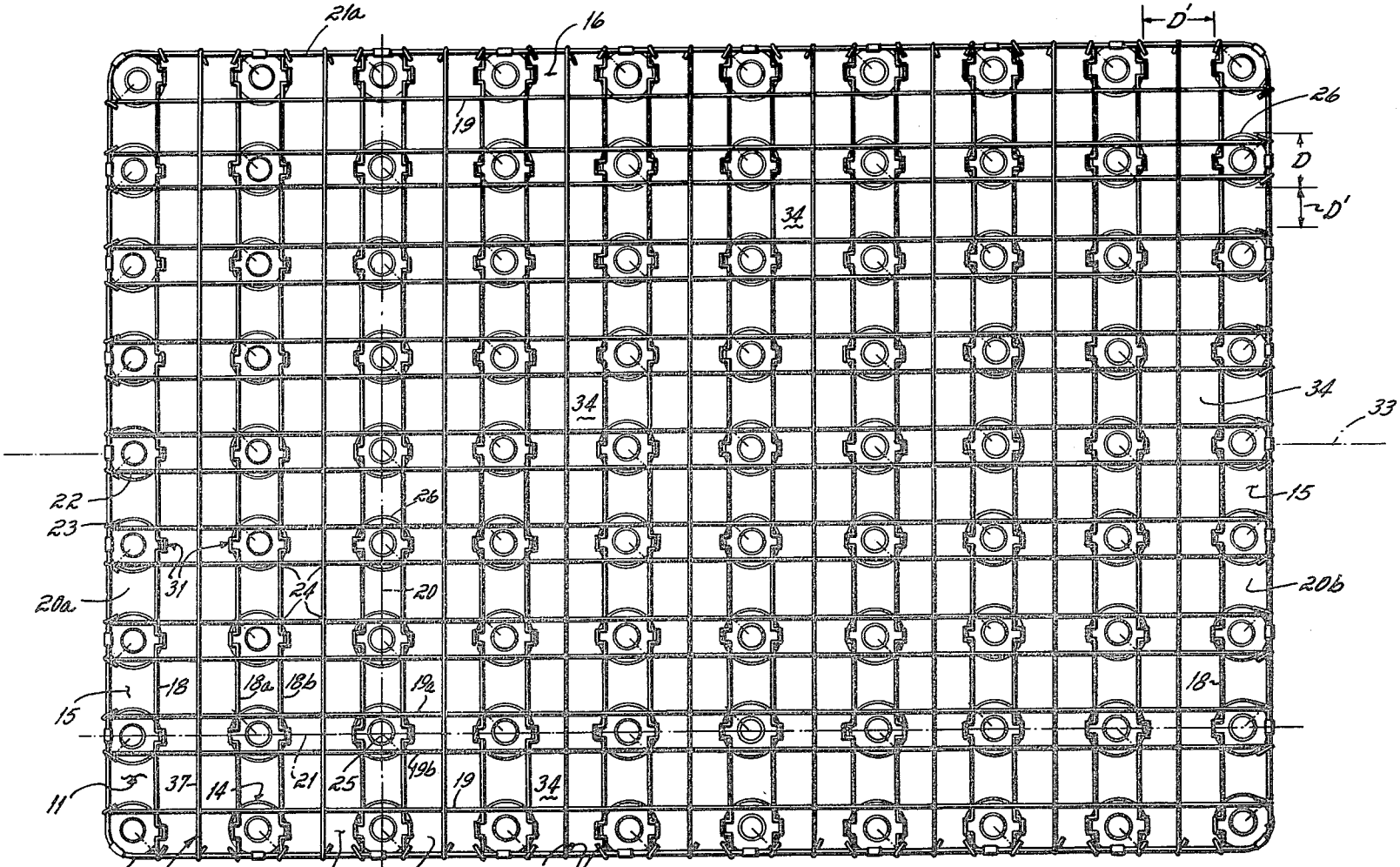
FIG. 1 is a top view of an improved box spring assembly structured in accord with the principles of this invention.
Figure 5:
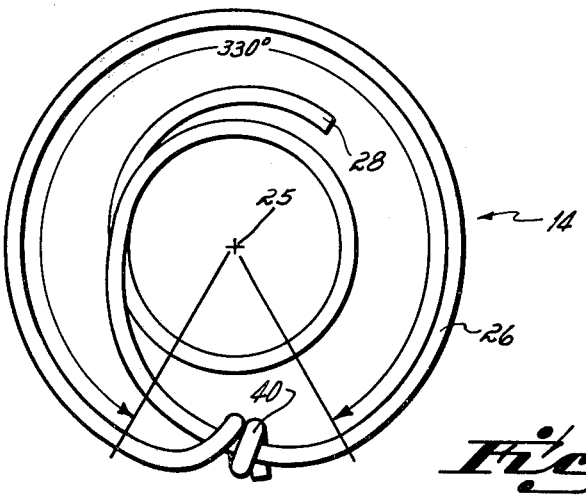
Figure 6:
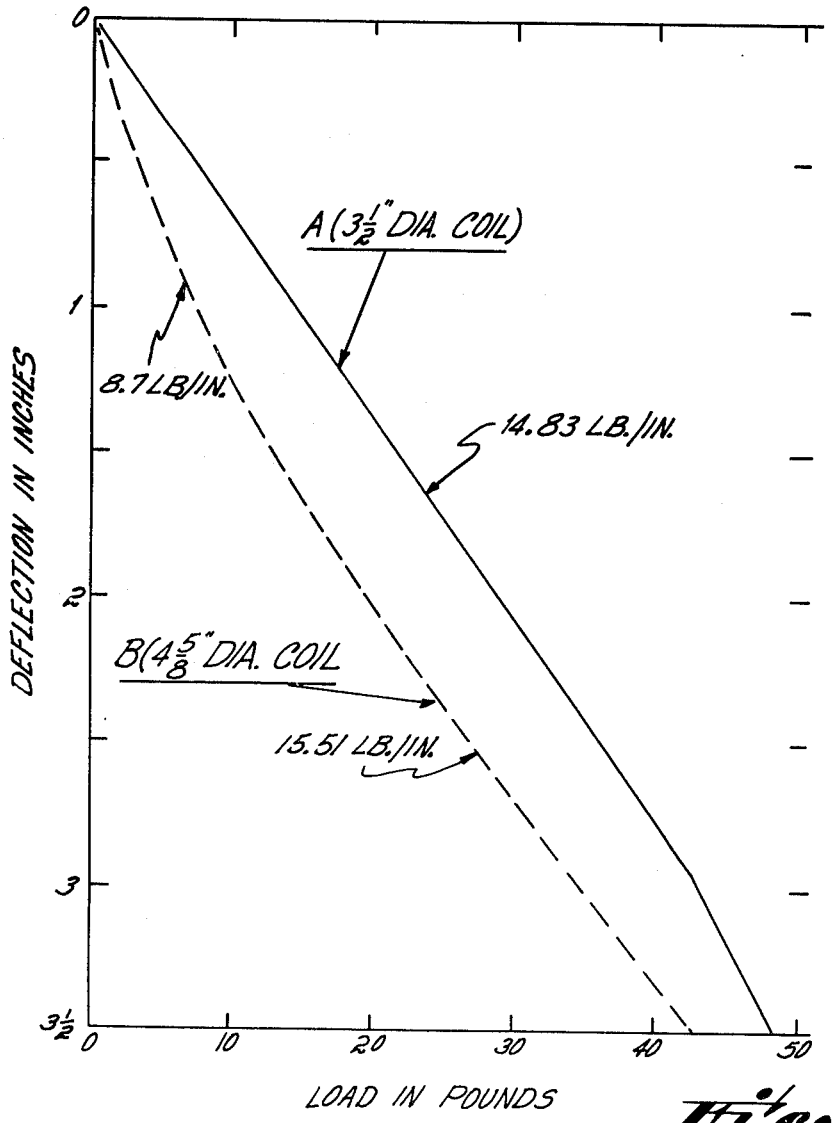

FIG. 5 is a top plan view of a single coil of the assembly of FIG. 1; and FIG. 6 is a load-deflection graph showing relative deflections of two different coils, one a conventional single cone coil having a top loop of approximately $4\frac{5}{8}$ inches diameter and the other a coil made in accordance with the practice of this invention from the same gauge wire and differing only in that it has a top loop of approximately $3\frac{1}{4}$ inches diameter.

As illustrated in the figures, the improved box spring assembly 10 of this invention comprises a wooden frame 11 located in the bottom plane of the assembly, a welded wire grid 12 and border wire 13 located in the top plane of the assembly, and a plurality of single cone type coil springs 14 located between the frame and the wire grid. As discussed in detail below, it is the size characteristics of the single cone type coil springs 14 and these coil springs in combination with the welded wire grid 12, which constitutes the novelty of the improved box spring assembly of this invention.

The base or frame 11 comprises a pair of end boards 15 and a pair of side boards 16, the end boards and the side boards being stapled or nailed together to form the rectangular frame and define the bottom plane of the box spring assembly 10. Transverse slats 17 extend between and are nailed to the tops of the side boards 16. Depending upon the width of the box spring assembly, there may be a longitudinal slat (not shown) nailed to the underside of the transverse slats 17, and to the end boards 15, to provide support for the transverse slats approximately midway of their length.

The border wire 13 is formed into a rectangular configuration which overlies the peripheral edge of the rectangular frame's end boards 15 and side boards 16. The wire grid 12 is secured to and located in the plane of the border wire 13, the grid and border wire defining the top plane of the box spring assembly. The wire grid comprises a plurality of pairs 18*a*, 18*b*, of transverse wires, and a plurality of pairs 19*a*, 19*b* of longitudinal wires, which wires all extend between opposite sides of the rectangular border wire 13. These pairs 18, 19 of grid wires are adapted to overlie, and cooperate with, the rows 20 and columns 21 of single cone type coil spring 14, the axes 25 of the springs within each row, and within each column, lying on a straight line. The left 20*a* and right 20*b* edge rows of coil springs 14, and the top 21*a* and bottom 21*b* edge columns of coil springs, have only a single transverse wire 18 and a single longitudinal wire 19, respectively, cooperating with the coil springs in those rows and columns. The border wire 13 itself establishes the second grid wire for the edge rows 20*a*, 20*b* and side columns 21*a*, 21*b*. Note particularly that the wire grid 12 also includes supplemental transverse wires 37 positioned between each pair of coil spring rows 20. Each supplemental transverse wire 37 is of a length equal to at least one of the coil spring transverse wires 18 adjacent thereto. In the embodiment shown, all supplemental transverse wires 37 are equal in length to all coil spring transverse wires 18.

The ends 22 of all the grid wires are hooked around the border wire 14, as at 23, and the ends of all the transverse wires 18, the longitudinal wires 19, and the supplemental transverse wires 37, are welded to the border wire also as at 23. The intersections or crossover points 24 of the transverse wires 18, the longitudinal wires 19, and the supplemental transverse wires 37 are also welded together, thereby providing the integral or welded wire grid 12. In manufacture, the border wire 13 and the grid 12 are all preformed into a welded subassembly. This subassembly may be fabricated by placing the transverse wire 18, the supplemental transverse wires 37, longitudinal wires 19 and border wire 13 within a fixture, and then spot welding all the hooked 23 and crossed 24 wire intersections.

Figure 2:
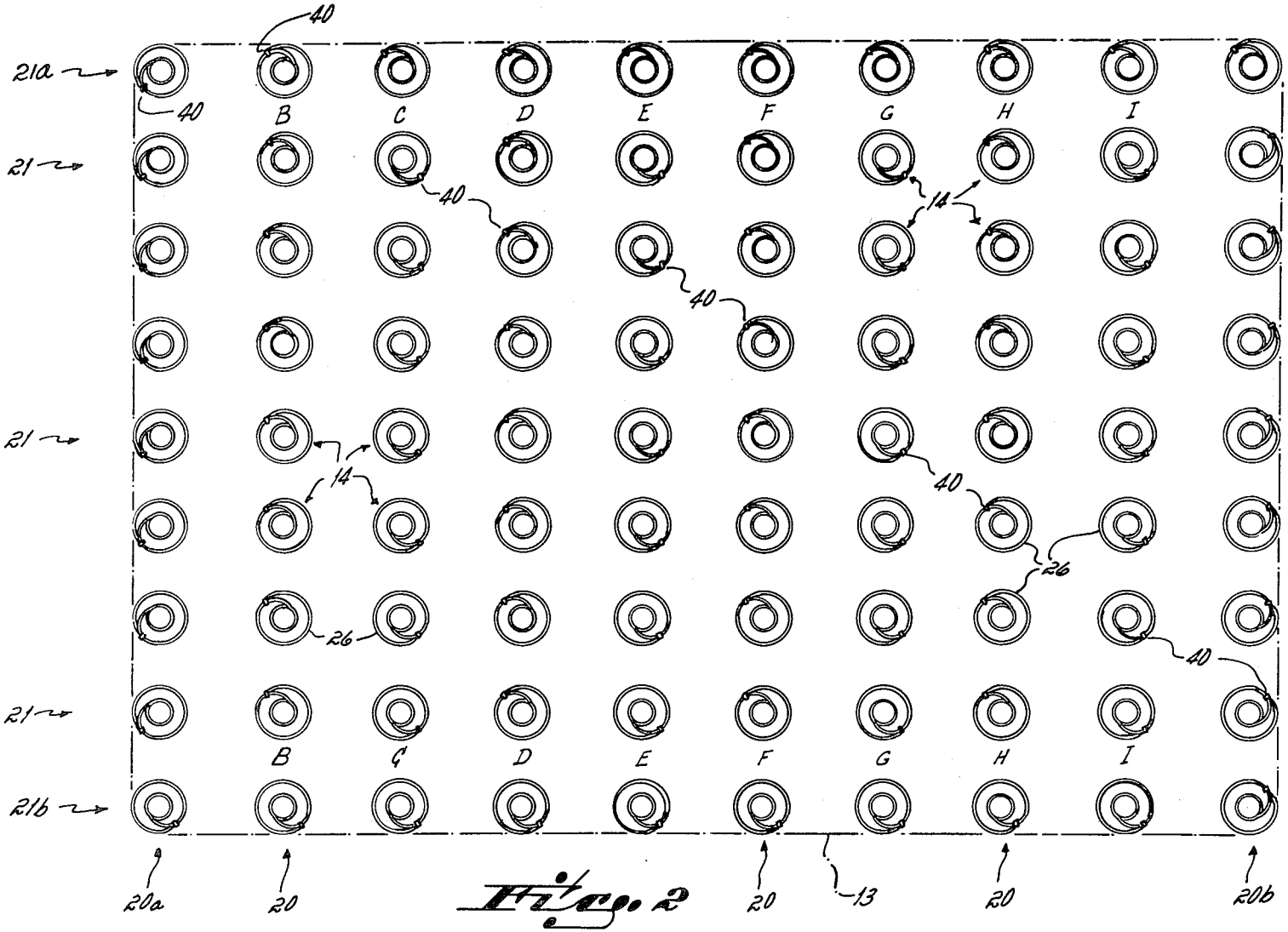
FIG. 2 is a partially diagrammatic top plan view of the box spring assembly of FIG. 1 showing the knot location of the coil throughout the unit.
Figure 3:
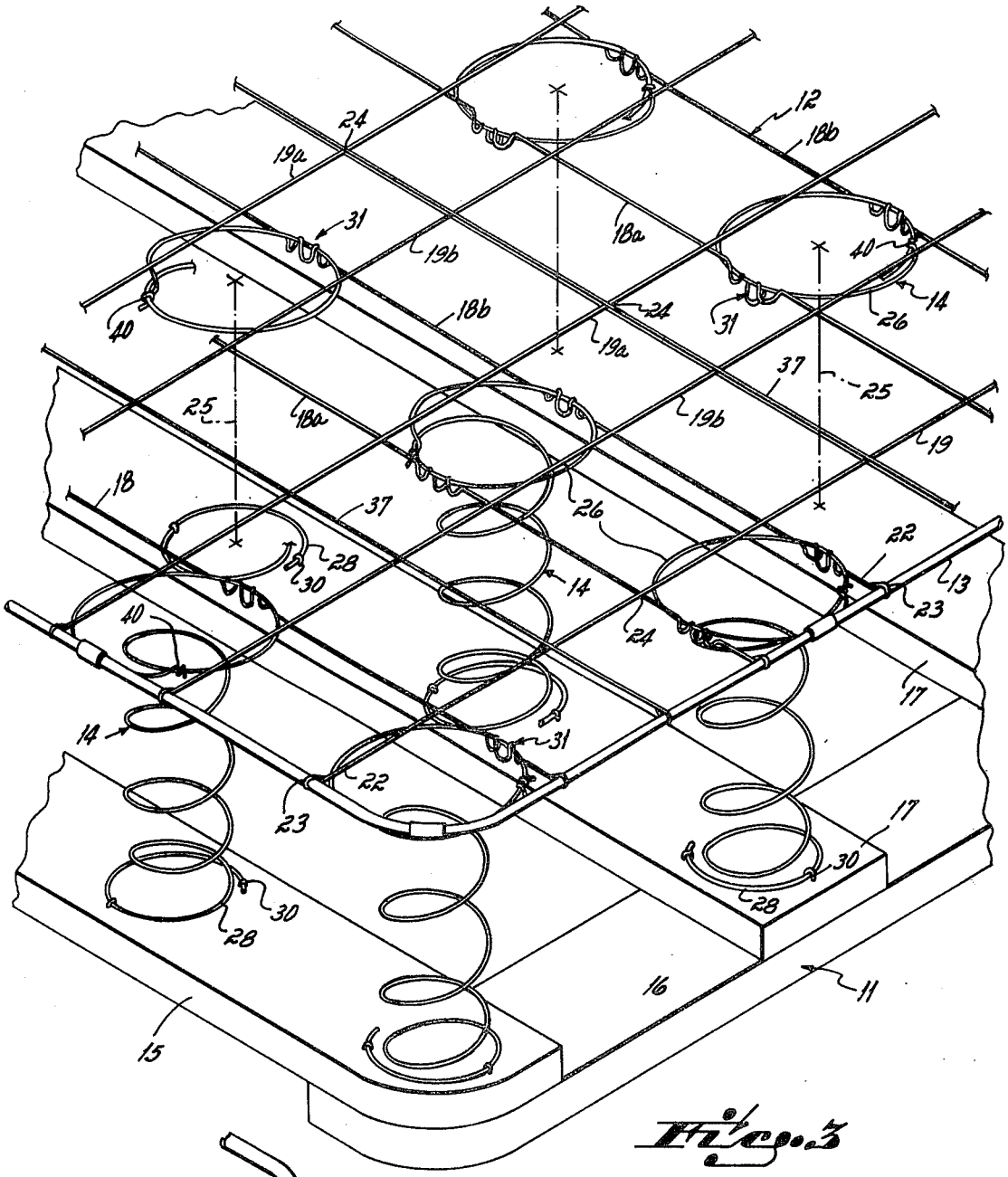
FIG. 3 is a perspective view of a portion of the box spring assembly illustrating the coil spring and welded wire grid structure.

As illustrated in FIGS. 1 and 2, the coil spring 14 utilized in the improved box spring assembly 10 of this invention is of the single cone type, and is frustoconical in cross-sectional configuration. The coil springs 14 are all vertically positioned within the box spring assembly, i.e., the axis 25 of each coil spring is oriented perpendicular to the parallel top and bottom planes of the box spring assembly. According to the practice of this invention, the diameter D of the top loop 26 of all coil springs 14 must not exceed more than three and one-half inches in diameter. It will be understood for purposes of this application that the diameter D of a coil spring, as referred to in this application, means the major diameter of the coil spring, i.e., the diameter of the top loop 26 of the coil spring 14, as measured adjacent the top plane of the box spring assembly. As illustrated in the figures, all coil springs 14 are of the same geometry and size. Further, note that each coil spring 14 is positioned from its adjacent coil spring a distance D′ at least as great as the diameter D of the coil spring. Specifically, and for adjacent coil spring 14 within a given row 20, the top loop 26 of each coil spring is positioned from the top loop of that coil spring to the right of same, and from the top loop of that coil spring to the left of same, a distance D′ at least as great as the diameter of the top loop of that coil spring. Further, each coil spring 14 within each column 21 of coil springs is positioned from that coil spring above it, and from that coil spring below it, a distance D′ at least as great as the diameter of the coil springs. In other words, the springs 14 within adjacent parallel rows 20, and within adjacent parallel columns 21, are spaced one from the other a distance D′ at least as great as the diameter of the coil springs.

Referring now to FIG. 2, there is illustrated the orientation of the coil knots which has been found to optimize load distribution between coils and simultaneously optimize lateral stability of the top plane of the coils. As there shown, the knots 40 of the edgemost coils in rows 20*a*, 20*b*, 21*a* and 21*b* are located immediately adjacent the border wire all the way around the spring assembly. Inside of the edgemost coils in rows 20*a*–21*b*, the knots 40 of each row are identically oriented and the knots of adjacent rows of coils are shifted or rotated 180°. That is, with reference to FIG. 2, the knots of the rows B, D, F and H are all located in approximately the seven o'clock position if the right hand side of the figure is designated as the 12 o'clock position. And the knots 40 of the coils in the alternating rows designed as C, E, G and I are located in approximately the one o'clock position. The inherent working of a knotted coil is that load is transferred from the topmost loop of the coil into the other coils through the knot so that there is greater resistance to deflection on the knotted side of the coil than on the side remote from the knot. Consequently, if the knots of all coils are identically oriented in the spring unit, the top of the unit when deflected will tend to shift laterally to the sides on which the knots are directed. Reverse positioning of the knots 180° out of phase in adjacent rows has the effect of eliminating the tendency of the top to shift upon deflection.

Figure 4:
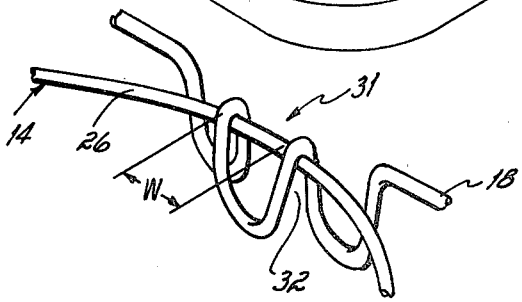
FIG. 4 is a perspective view of an interconnection between the grid and one coil spring.

The bottom loop 28 of each coil spring 14 is fixed to the wooden bottom frame 11 by staples 30 in a manner well known to the art. The top loop 26 of each coil spring 14 is fixed to the wire grid 12 in the top plane of the box spring assembly by hooks 31 formed in the transverse wires 18 of the wire grid. Each transverse wire 18*a* and 18*b* of each pair 18 of transverse wires (each such pair 18 serving a row 20 of coil springs 14 in the box spring assembly 10) is provided with a double reversely bent hook 31 preformed into that transverse wire of the welded wire grid. Each hook 31 is formed as an open U-shaped element which opens downwardly so that the grid 12 may be placed over the coil springs 14 with each top loop 26 of each of the coil springs located in two such hooks. The open portion 32 of each U-shaped configured hook 31 is then bent to a closed condition so as to lock the coil spring's top loop 26 within the U-shaped section of the transverse wires 18, i.e., so as to interconnect the coil springs 14 with the welded wire grid, all as illustrated in FIG. 4. Thus, each coil spring 14 is affixed only to the transverse grid wires 18 of the welded wire grid 12, and not to the longitudinal grid wires 19 nor to the supplemental grid wires of the welded wire grid, in the top plane of the box spring assembly 10.

To assemble the coils into the preformed welded wire grid 12 in the reversed row orientation illustrated in FIG. 2, I have found that it is necessary to have the nominal diameter D of the topmost loop of each coil maintained to an accuracy of ±0.015 inches throughout approximately a 330° arcuate section (FIG. 5) of the topmost loop. This accuracy of the diameter is necessary whenever small diameter single cone coils (of less than 3½″ dia.) are assembled into the preformed hooks 31 of the grid because a relatively large arcuate section of the top loop must be received within the width W (FIG. 4) of the hook. Heretofore, whenever larger diameter coils were assembled into the same preformed hook of the welded wire grid, a much flatter section of the top loop was received within the hook. With the practice of this invention and its employment of a smaller diameter coil, the top loop of the coil must be much more accurately sized than has heretofore been necessary. I have found that in order to obtain consistency of top loop coil diameter throughout a 300° arcuate section of the top loop, and from one machine-made coil to the next, it is necessary that the coil be formed of wire held to a nominal wire diameter accuracy of 0.0005 inch. Conventionally, commercial grade wires of the type used in forming this type of spring, as for example 11 gauge wire, is held to an accuracy of ±0.002 inch. If the wire is held to this accuracy, these top loops of the coils may be formed to a nominal diameter ±0.015 inch throughout a 300° arcuate section of the coil. If this diameter tolerance is maintained, then small top loop diameter single cone springs of less than 3½" diameter may be successfully employed in preformed hook 31 type grid top spring assemblies.

More specifically, with reference to an improved box spring assembly in accord with the principles of this invention which is sized to serve a standard bed frame, i.e., a standard bed size box spring as referred to in the trade, and as shown in the figures, the standard bed size box spring assembly is comprised of ten rows 20 of single cone type coil springs 14, and nine columns 21 of single cone type coil springs (reference to a column referring to a line of coil springs aligned parallel to the longitudinal axis 33 of the box spring assembly 10, and reference to a row referring to a line of coil springs aligned transverse to the longitudinal axis of the box spring assembly). The centerline diameter, i.e., the top loop 26 diameter, of the coil springs 14 is 3.19 inches for each of the ninety coils. The distance between columns 21 of coil springs is 6.094 inches, and the distance between rows of coil springs is 7.805 inches, all as measured centerline-to-centerline. The centerline distance between wires 19*a*, 19*b* of each longitudinal wire pair of the grid (each pair serving a column 21 of coil springs 14) is 2.25 inches, and the centerline distance between wires 18*a*, 18*b* of each transverse wire pair of the grid (each pair serving a row of coil 20 springs) is 2.714 inches, each wire pair being oriented parallel to and symmetrically disposed relative to the centerlines of columns 21 and rows 20, respectively. The supplemental transverse wires are positioned parallel to and symmetrically between adjacent pairs 18 of transverse wires. The centerline distance between transverse wire 18 and the border wire 13 in left 20*a* and right 20*b* rows is 3.002 inches, and the centerline distance between longitudinal wire 19 and the border wire in side columns 21*a*, 21*b* is 2.75 inches. The border wire 13 diameter is 0.243 inches, the grid wire diameter is 0.086 inches and the coil spring wire diameter is 0.120 inches. The length of the box spring assembly 10 is 73.50 inches, the width of the box spring assembly is 52.0 inches.

From a practical standpoint, the improved box spring 10 assembly of this invention, through the small diameter of the coil springs 14, in combination with the wire grid 12, provides a box spring assembly that achieves a degree of firmness desirable in the marketplace with a lesser quantity of wire contained in the assembly than has been present in box spring assemblies comprised of large diameter coil springs. Further, and because of the interaction of the welded wire grid 12 with the columns 21 and rows 20 of the coil springs 14 as interconnected therewith, no appreciable abrading occurs of the pad (not shown) located on top the wire grid in the finished box spring assembly 10 during prolonged use of that assembly. In other words, the pad (not shown) does not tend to abrade or wear so that the stuffing does not pass down through gaps or holes 34 between opposed pairs of transverse grid wires 18, and between opposed pairs of longitudinal grid wires 19, during use. Further, the improved box spring assembly 10 of this invention, through use of the welded wire grid 12 interconnected with each of the coil springs 14, provides lateral stability to the individual springs as well as the box spring assembly itself, i.e., the coil springs tend to compress vertically or axially and do not tend to sway or angulate during use. These advantages permit the economical manufacture and sale of a box spring assembly using coil springs 14 of a diameter 3½" or less, and with a spacing between spring columns 21 and rows 20 equal at least to the diameter of the springs; that objective not heretofore being attainable or known to the prior art.

The characteristics of the improved single cone coil spring which characterizes the invention of this application are best illustrated and described with reference to FIG. 6. There illustrated are the load to deflection plots of two single cone coil springs which are identical except that one spring plotted on solid line A has a small diameter top loop of approximately 3½" diameter and the other spring (plotted on dashed line B) has a standard large top loop diameter of 4⅝" diameter. Both tested springs were standard 5 turn coils made from 11 gauge wire, the only difference being in the diameter of the top loop. It will be seen that solid line A reflecting the load to deflection curve of the small diameter coil spring is a straight line until three inches of deflection is recorded and that approximately 14.83 pounds of load was required to effect each inch of deflection up to this point. The load to deflection line curve B of the standard large diameter coil on the other hand is convex, reflecting the fact that the coil is initially "soft", requiring approximately 8.7 pounds of force to effect the first one inch of deflection and very nearly twice that force, 15.51 pounds to effect the third inch of deflection. This changing firmness characteristic is very undesirable, as is the relative initial "softness" of the spring. As may be seen by this relative plot, the invention of this application effects increased firmness and consistent spring ratios, i.e., load to deflection curves, with a spring of lesser diameter and consequently lesser cost.

Having described in detail the preferred embodiment of my invention, what I desire to claim and protect by Letters Patent is:

1. A small diameter single cone coil spring for use in a box spring, said single cone coil spring comprising a single strand of round cross section wire formed into a top loop and at least three additional helically wound loops of decreasing diameter, the end of said top loop being wrapped around the next adjacent loop to form a knot in said coil, the improvement wherein said top loop of said spring has a diameter of less than 3½ inches so that said spring has increased firmness relative to otherwise identical springs having top loops of substantially greater diameter, and so that said spring exhibits a substantially straight line deflection curve over a major portion of its possible range of deflection.

2. The coil spring of claim 1 wherein said top loop diameter is maintained to an accuracy of plus or minus 0.015 inch through an arcuate section of at least 300°.

3. The coil of claim 1 wherein said single strand of wire has a nominal diameter maintained to an accuracy of 0.0005 inch.

* * * * *